United States Patent [19]

James et al.

[11] 4,193,491

[45] Mar. 18, 1980

[54] APPARATUS FOR FEEDING STACKS OF SHEETS, SUCH AS REAMS OF PAPER

[75] Inventors: Robert C. James; Lloyd Kovacs, both of Sheboygan, Wis.

[73] Assignee: Hayssen Manufacturing Company, Sheboygan, Wis.

[21] Appl. No.: 912,953

[22] Filed: Jun. 6, 1978

[51] Int. Cl.[2] ..... B65G 37/00

[52] U.S. Cl. ..... 198/476; 198/482; 198/725

[58] Field of Search ..... 198/725, 482, 474, 734, 198/735, 728, 727, 476, 726

[56] References Cited

U.S. PATENT DOCUMENTS

| | | | |
|---|---|---|---|
| 2,640,578 | 6/1953 | Schroenghamer | 198/726 X |
| 2,722,305 | 11/1955 | McCabe | 198/482 |
| 2,815,116 | 12/1957 | Erickson | 198/734 X |

*Primary Examiner*—Joseph E. Valenza
*Assistant Examiner*—Douglas D. Watts
*Attorney, Agent, or Firm*—Senniger, Powers, Leavitt and Roedel

[57] ABSTRACT

Apparatus for feeding stacks of sheets, in particular reams of paper, comprising a table along which the stacks are pushed forward by the flights of a flight conveyor, each flight having a foot adapted to support the stack, and the apparatus having means for lifting each stack, after it has been placed on the table in position for being pushed forward by a flight, to enable the foot of the flight to come under the stack.

9 Claims, 7 Drawing Figures

APPARATUS FOR FEEDING STACKS OF SHEETS, SUCH AS REAMS OF PAPER

BACKGROUND OF THE INVENTION

This invention relates to apparatus for feeding stacks of sheets, and more particularly to a flight conveyor apparatus for such purpose.

The invention is especially concerned with apparatus for feeding reams of paper, such as reams of 8½" by 11" sheets of paper (a ream consisting of 500 sheets of the paper). Such reams are presently produced in vast quantities by means of an apparatus called a "sheeter", which cuts paper into sheets of the desired size (e.g., 8½" by 11") and stacks up the sheets in reams of 500 sheets. The reams are then fed to a wrapper, wherein they are wrapped in a sheet of wrapping paper. In certain installations, the reams are fed into the wrapper by a flight conveyor apparatus, generally comprising a table having an upper surface on which the reams may slide, and endless conveyor means having flights spaced at intervals along its length for pushing the reams along the table, the endless conveyor means having an upper reach extending under the table in the direction of feed and movable in the direction of feed. Each flight has a section adapted in its travel with the upper reach of the conveyor to extend up through a longitudinal slot in the table, this section carrying a pusher plate adapted, as the flight moves forward with the upper reach of the coveyor, to travel over the table and push a ream forward on the table. Heretofore, it has been customary to provide the pusher plates with relatively narrow tabs extending down from their lower edge into grooves extending longitudinally of the table, to insure that the lower sheets of each ream are engaged and pushed forward. In many instances, however, it was found that these narrow tabs indented or gouged the lower sheet or a number of the lower sheets of the ream (at the trailing side of the ream in the course of its being pushed forward), such indentations being undesirable inasmuch as they tend to interfere with handling of the sheets in equipment, e.g., copying machines, in which the sheets are ultimately used. Consideration has been given to having the pusher plate extend down into a relatively wide groove (slightly wider than the plate) in the table to avoid the gouging effect of the narrow tabs, but this presented the problem that the reams tended to sag down into the groove with resultant undesirable marking of the ream along the edges of the table at the sides of the groove as the ream slides forward on these edges. Thus, there has been a problem of insuring that the lower sheet or sheets of a ream are pushed forward by the flights without damaging them.

SUMMARY OF THE INVENTION

Among the several objects of this invention may be noted the provision of improved apparatus for feeding stacks of sheets, and particularly reams of paper, of the above-noted flight conveyor type, with insurance that all the sheets of each stack down to and including the lower sheet are positively engaged by a flight for being pushed forward, without indenting or gouging the lower sheet or sheets or otherwise damaging the ream; and the provision of such apparatus which, while being relatively simple and economical to provide, considering its accomplishments, is reliable in operation.

In general, apparatus of this invention is adapted for feeding stacks of sheets, such as reams of paper or the like, and comprises flight conveyor means for pushing the stacks forward, this flight conveyor means comprising a table having an upper surface on which the stacks may slide. The table has a relatively narrow slot extending in the direction of feed. The flight conveyor means further comprises endless conveyor means having flights spaced at intervals along its length and extending outwardly therefrom for pushing the stacks along the table, said conveyor means having an upper reach extending under the table in the direction of feed and movable in the direction of feed. Each flight has a relatively narrow section adapted, in its travel with the upper reach of the conveyor means, to extend up through said slot, and a relatively wide pusher face adapted, as the flight moves forward with the upper reach of the conveyor means, to travel over the table and push a stack forward on the table. Each flight further has a foot extending forwardly from its said pusher face adapted, in the travel of the flight with the upper reach of the conveyor means, to travel at a level for supporting the stack being pushed forward by said face. Stacks are fed on to the table to a dwell position between successive flights. The apparatus further comprises means for lifting a stack in its said dwell position for entry under the lifted stack of the foot of the flight coming into engagement with the trailing side of the stack, the stack being supported on said foot as said flight travels forward. In this way, all the sheets of the stack, down to the bottom sheet of the stack, are adapted for engagement by the said relatively wide pusher face of said flight (instead of by narrow tabs) and there is no sagging of the ream into a wide groove.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
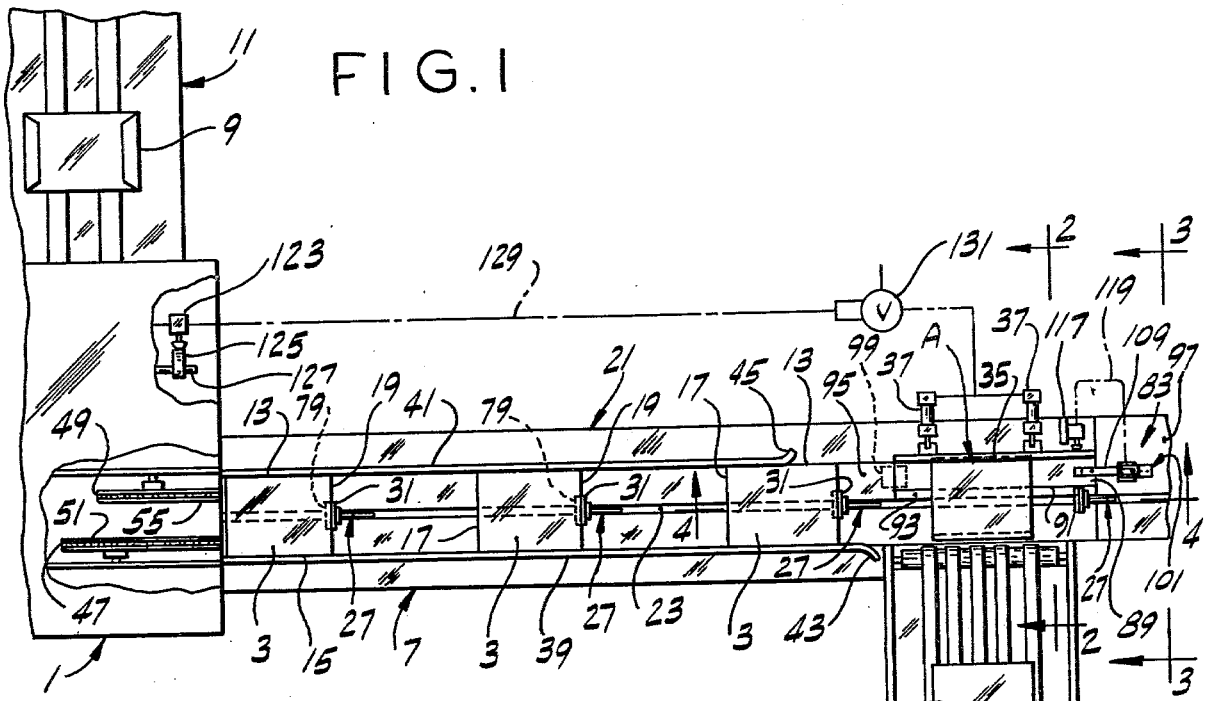
FIG. 1 is a view showing in plan means for feeding reams of paper to a wrapper, including apparatus of this invention.

Referring to FIG. 1 of the drawings, there is generally indicated at 1 wrapping apparatus to which reams 3 of paper are fed for being wrapped. Each ream is, for example, a stack of 500 8½" by 11" sheets of paper. The reams are shown as being fed to the wrapping apparatus by a belt conveyor 5 and a flight conveyor apparatus 7. The wrapped reams, one of which is indicated at 9, are fed away from the wrapping apparatus by an outfeed conveyor 11. The belt conveyor 5 receives reams as they are produced by a sheeter (not shown) and delivers them to the flight conveyor apparatus 7. The latter acts to push the reams into the wrapping apparatus 1, and has the present invention incorporated therein, as will appear.

The wrapping apparatus or wrapper 1 may be of any suitable well-known type for applying a sheet of wrapping paper around a product which has the form of a rectangular parallelepiped. Reference may be made to the coassigned U.S. Pat. No. 3,861,120 issued Jan. 21, 1975 for a disclosure of such a wrapper. Flight conveyor apparatus 7 delivers the reams to the wrapper 1 from the right as viewed in FIG. 1. Belt conveyor 5 and flight conveyor 7 are at right angles to one another. Conveyor 11 feeds out of wrapper 1 at right angles to flight conveyor 7 with the conveyors in a "Z" arrangement as shown. They may be in a "U" arrangement.

The flight conveyor 7 feeds the reams forward one after another to the wrapper 1 with two opposite sides 13 and 15 of each ream extending generally in the direction of feed and the other two opposite sides 17 and 19 extending generally transversely to the direction of feed. As illustrated in FIG. 1, the reams are rectangular, 13 and 15 being the long sides and 17 and 19 being the shorter sides. In the case of reams of 8½" by 11" sheets, sides 13 and 15 would be the 11" sides and sides 17 and 19 would be the 8½" sides. The reams are fed forward on the belt conveyor 5 with the long sides 13 and 15 transverse to the direction of feed of conveyor 5 and the short sides 17 and 19 extending in the direction of feed. With flight conveyor 7 extending at right angles to belt conveyor 5, the reams as delivered by belt conveyor 5 to flight conveyor 7 become oriented with their long sides 13 and 15 extending in the direction of feed of 7 and their short sides 17 and 19 extending transversely of the direction of feed of 7.

The flight conveyor 7 comprises an elongate table 21 having a stationary upper surface on which the reams (stacks) 3 may be pushed to slide them over the table lengthwise of the table toward the wrapper 1. The table has a relatively narrow slot 23 extending longitudinally of the table, i.e., in the direction of feed of the reams. The flight conveyor 7 further comprises endless conveyor means 25 having flights 27 spaced at equal intervals along its length and extending outwardly therefrom for pushing the reams along the table. The endless conveyor means has an upper reach 25*a* extending under the table in the direction of feed and movable in the direction of feed. Each flight 27 comprises a relatively narrow arm 29 extending up from the upper reach 25*a* through the slot 23 in the table, with a pusher plate 31 on the arm above the upper surface of the table for pushing a ream forward on the table. The pusher plates are spaced at intervals greater than the length of the reams, as is apparent from FIGS. 1 and 4.

Belt conveyor 5 delivers reams to the flight conveyor 7 at relatively high speed (e.g., 90 reams per minute corresponding to a wrapping rate of 90 reams per minute) from the left side of the flight conveyor 7 as viewed looking toward the wrapper 1 (i.e., downstream of conveyor 7) being timed in relation to conveyor 7 to deliver each ream between two successive flight pusher plates 31 of conveyor 7. Each ream, as delivered to conveyor 7 by conveyor 5, is fed (at relatively high speed) transversely across the table 21 from left to right (as viewed in the direction toward the wrapper), and the leading side of the ream, which here is its side 13, strikes a stop 35 constituted by a vertical plate extending longitudinally of the table on the right side of the path of the pusher plates 31 of the endless conveyor means 25 to arrest the ream in the appropriate lateral position for its ongoing travel on the table 21 toward the wrapper 1. The stop plate 35 is carried by shock absorbers 37, which may be air cylinders acting as air dashpots, allowing for cushioning of the impact of the ream against the stop plate.

After delivery by the belt conveyor 5 of each ream 3 to the flight conveyor 7, with arrest of the ream against the stop plate 35, the ream dwells momentarily in a dwell position between two successive flight pusher plates 31 and then is pushed forward on the table 21 by a pusher plate 31 of the endless conveyor means 25. As it is fed forward, it passes between guide plates 39 and 41 extending in the direction of feed, these guide plates having outwardly curved rear ends 43 and 45 for guiding the ream in between the guide plates.

Figure 7:
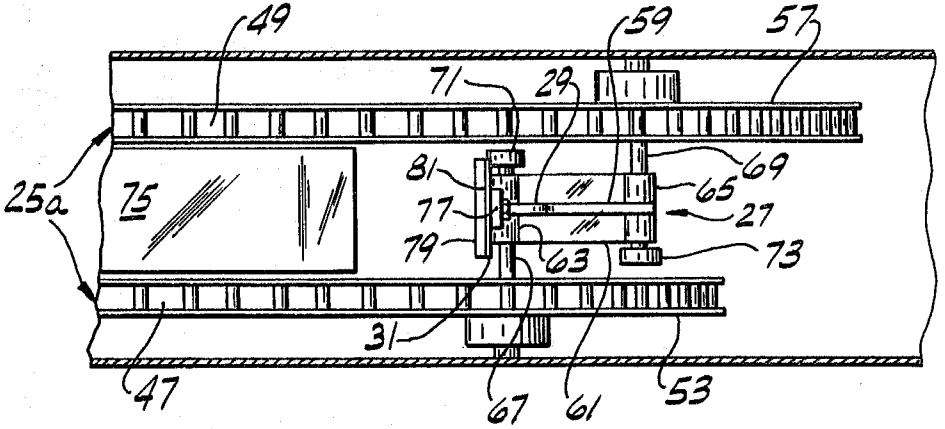
FIG. 7 is a horizontal section generally on line 7—7 of FIG. 6.
Figure 6:
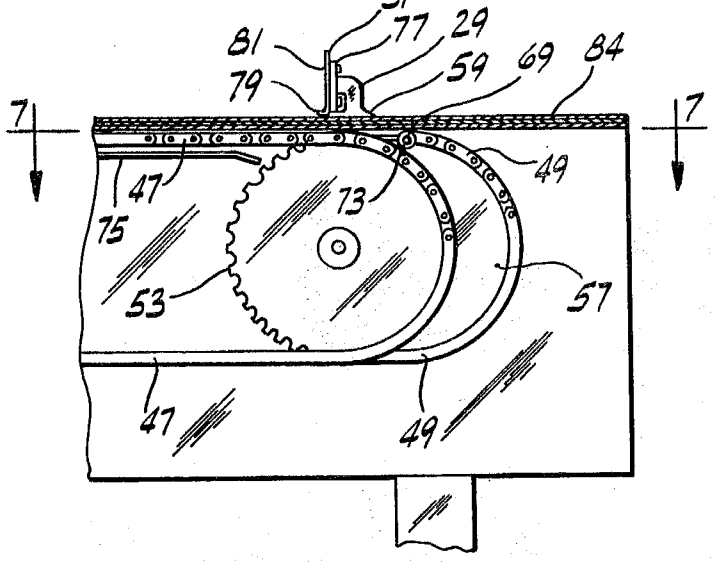
FIG. 6 is a vertical longitudinal section generally on line 6—6 of FIG. 3, parts being omitted.

The endless conveyor means 25 of the flight conveyor 7 comprises a pair of chains 47 and 49, one at the left and one at the right as viewed in the direction toward the wrapper 1, with chain 47 trained around forward and rearward sprockets 51 and 53 and chain 49 trained around forward and rearward sprockets 55 and 57. The two sprockets 51 and 53 are longitudinally offset from the sprockets 55 and 57 so that the two chains are in effect longidutinally offset (see FIGS. 1, 6 and 7). The upper reaches of the two chains are coplanar in a horizontal plane just under the table 21, and are located on opposite sides of the vertical plane of the slot 23. Each of the flight arms 29 comprises a relatively thin flat member extending from a web 59 on a base 61 having a sleeve 63 at one end constituting its leading end and a sleeve 65 at its other end constituting its trailing end, sleeve 63 receiving a pin 67 extending laterally from chain 47 toward chain 49 and sleeve 65 receiving a pin 69 extending laterally from chain 49 toward chain 47. The pins 67 and 69 carry rollers 71 and 73 adapted to roll on a track 75 under the table.

At the leading end of each arm 29 is a head 77 to which is suitably secured the pusher plate 31. The latter is a sheet metal plate which is relatively wide in relation to the width of slot 23, typically having a width of about 2½" for pushing a ream of 8½" by 11" sheets, and a height of about 3⅛" for such a ream, which is typically about 2⅛" in thickness (height). The plate has a foot 79 constituted by an integral flange extending forwardly from the plate at its edge which is its bottom edge as the plate and arm travel forward with the upper reach 25*a* of the double-chain conveyor means 25. The plate 31 provides a relatively wide pusher face 81 on the arm 29 for engagement with the trailing side of a ream 3 on the table 21 to push the ream forward on the table. The foot 79 extends forwardly from this pusher face and is adapted, in the travel of the respective flight with the upper reach 25*a* of the conveyor means 25, to travel at a level just above the upper surface of the table for supporting the ream being pushed forward by the said face 81, with the ream supported by the foot throughout the width of the plate at the trailing side 19 of the ream.

As noted above, the reams 3 are fed on to the table 21 by the belt conveyor 5 to the dwell position, which is indicated at A in FIG. 1, between successive flights 27 of the conveyor means 25. The ream dwells in position A at a level below the level of the post momentarily until the pusher plate 31 of a flight 27, travelling toward the ream, engages the trailing side 19 of the ream and pushes the ream forward along the table. Just before the pusher plate 31 reaches the ream at position A, however, the ream is lifted by lifting means indicated generally at 83 to a leve at which the lower surface of at least a portion of the ream is above the level of the foot for entry under the lifted ream of the foot 79 of the pusher plate 31 coming into engagement with the trailing side 19 of the ream. The ream then comes to bear upon and is supported on the foot 79 as the pusher plate 31 travels forward.

The top of the table is formed of an upper layer of plating 84 on a lower layer of plating 85, the slot 23 extending through both of these layers, and the upper surface 87 of the upper layer constituting the upper surface of the table over which the reams slide. This surface 87 is made smooth for this purpose. Slot 23 is narrow so that the reams do not sag down into the slot to any appreciable extent. The lifting means comprises an elongate relatively narrow lifter plate 89 extending longitudinally of the table at one side of the slot 23 at the dwell position A of a ream, pivoted at its forward (downstream) end 91 for swinging movement about a horizontal transverse axis between a lowered horizontal position wherein its upper surface is generally flush with the upper surface 87 of the upper table plating 83 and a raised position for lifting a ream at position A. To accommodate this lifter plate 89, the upper table plating has a recess 91 therein for the plate 89, this recess being bounded at one side by a narrow strip 93 of the upper plating extending along the slot 23, and at its forward and rearward ends by portions 95 and 97 of the upper plating. Plate 89 is made of the same stock as plating 84, so that when it is down flat in the recess 91 overlying plating 85, its upper surface is essentially flush with the upper surface 87 of the plating 84. The plate 89 is pivoted for its swinging movement between its lowered and raised positions by means of a leaf spring hinge 99 underlying the forward end of plate 89 and portion 95 of the upper plating. It extends from a point rearward of (upstream from) position A to a point forward of (downstream from) position A, located between the slot 23 and stop plate 35.

Figure 2:
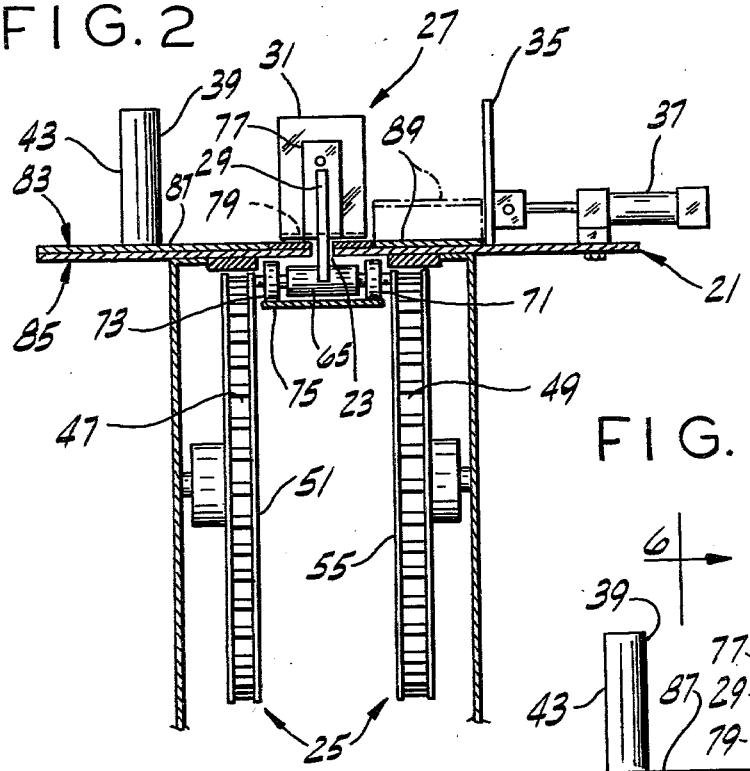
FIG. 2 is an enlarged vertical transverse section of the apparatus of this invention generally on line 2—2 of FIG. 1, showing a ream lifter of the apparatus in its lowered position in solid lines and in its raised position in phantom.
Figure 3:
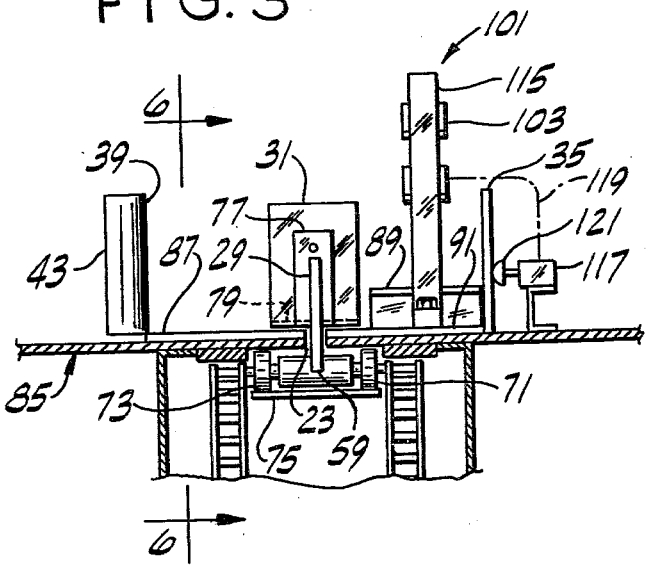
FIG. 3 is an enlarged vertical transverse section generally on line 3—3 of FIG. 1, showing the ream lifter in its raised position in solid lines.

At 101 is generally indicated means for swinging the plate 89 between its lowered and lifted positions, this means being wholly clear of a ream as it is fed to the dwell position A. It comprises an air cylinder 103 having its piston rod 105 connected as indicated at 107 to an arm 109 extending rearward from the rear end of plate 89. The air cylinder 103 is mounted on a block 111 pivoted at its upper end as indicated at 113 in a support 115 mounted on the table 21 rearward of the rear end of the plate 89. The arrangement is such that, with piston rod 105 extended, plate 89 is down in the lowered horizontal position in which it is shown in solid lines in FIG. 2 in the recess 91 in the upper plating 84 of the table. On retracting the piston rod 105, plate 89 is swung up to its raised position of FIG. 4 (see also FIGS. 3 and 5) for lifting a ream.

Figure 4:
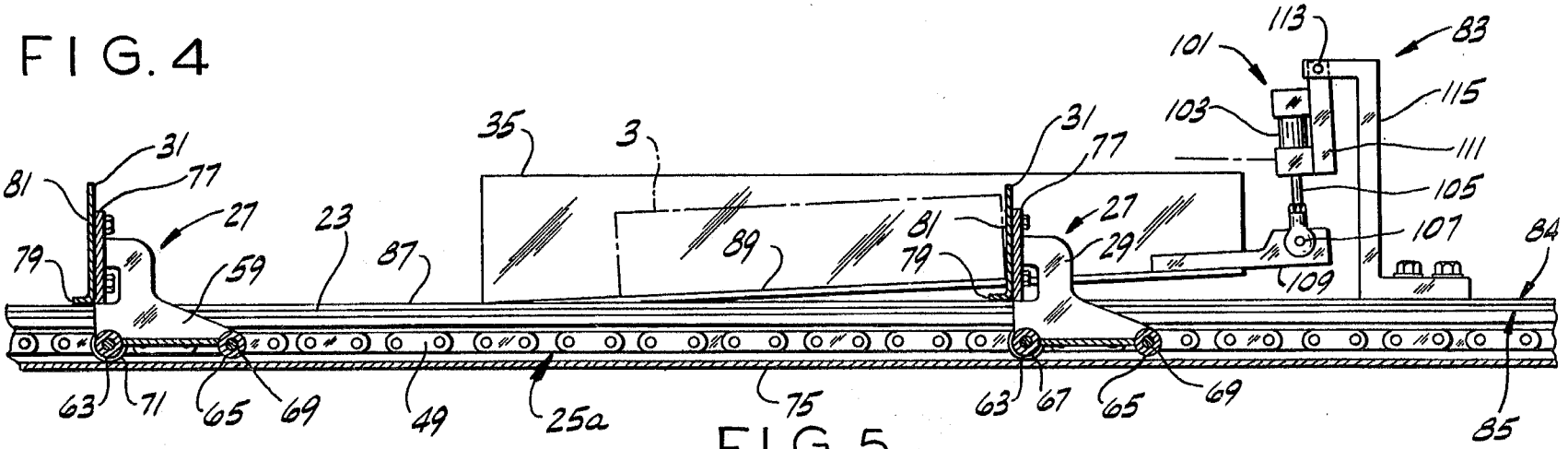
FIG. 4 is an enlarged vertical longitudinal section of the apparatus of this invention generally on line 4—4 of FIG. 1 showing the ream lifter in its raised position and illustrating how it thereby lifts a ream for entry under the lifted ream of the foot of a flight of the flight conveyor.
Figure 5:
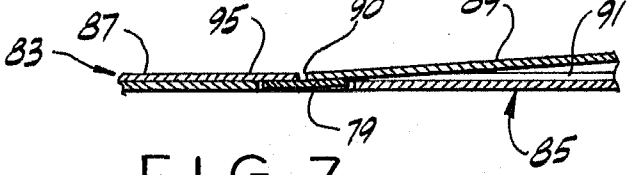
FIG. 5 is an enlarged vertical section showing the detail of a hinge for the ream lifter.

Operation of the air cylinder 103 for lifting and lowering the lifter plate 89 is under control of a valve 117 connected as indicated at 119 to the cylinder, the valve in turn being controlled by the stop plate 35. The arrangement is such that when the stop plate is moved back by a ream fed on to table 21 by the belt conveyor 5, the stop plate engages the actuator 121 of valve 117 and actuates the valve to deliver air to the air cylinder 103 to cause its piston rod 105 to be retracted to lift the lifter plate 89. The stop plate air cylinders 37 are actuated to return the stop plate 35 to its initial position in timed relation to the flight conveyor 7 by means of a switch 123 controlled by a timing cam 125 on a timing shaft 127 in the wrapper 1, the switch being connected as indicated at 129 to a solenoid valve 131 controlling the air cylinders 37. The arrangement is such that upon delivery of a ream by conveyor 5 to conveyor 7 wth attendant yielding of the stop plate 35, valve 117 is actuated by the stop plate, effecting lifting of the lifter plate 89 to lift the ream as illustrated in FIG. 4. With the ream so lifted, the foot 179 of the pusher plate 31 of the oncoming flight 27 is enabled to enter under the ream. Then, in timed relation to the travel of the flight, the stop plate 89 is returned to its initial position by the air cylinders 37, and this deactivates valve 117 for the lowering of lifter plate 89 to its lowered position.

In operation, conveyors 5 and 7 are continuously driven, with conveyor 5 functioning to deliver reams one after another to conveyor 7, each ream being delivered to conveyor 7 between two successive flight pusher plates 31 of conveyor 7. It will be understood that while conveyor 7 is essentially continuously driven, it may accelerate for feeding the reams to the wrapper and decelerate during a wrapping interval. Each ream is delivered to conveyor 7 at relatively high speed and as it travels across the table 21 adjacent the rearward (upsteam) end of the table it engages the stop plate 35 with sufficient force to cause the stop plate to yield. The stop plate 35, in so yielding, actuates valve 117 to effect lifting of the lifter plate 89 to lift the ream. Plate 89 lifts the ream at the trailing side 19 of the ream high enough for the foot 79 of the oncoming flight 27 of the flight conveyor 7 to enter under the ream. In timed relation to the entry of the foot under the ream, switch 123 is actuated by cam 125 to actuate valve 131 to deliver air to cylinders 37 to return the stop plate 35 to its initial position, thereby lining up the ream for its ensuing travel along the table 21. On the return of the stop plate 35, valve 117 is deactuated to effect the lowering of the lifter plate 89 to its lowered position flush with the table for the delivery of the next ream by the conveyor 5 to the conveyor 7. It will be noted that with plate 89 being flush with the table when swung down to its lowered position, a ream delivered by conveyor 5 is able to slide over the table (without obstruction) to position A for being picked up by the oncoming flight of conveyor 7.

The ream, engaged at its trailing side 19 by the wide face 81 of the flight pusher plate 31, and bearing on the foot 79 of the plate 31, is pushed to the wrapper 1 by the plate. With the face 81 relatively wide, extending laterally outward on both sides of slot 23, there is no indentation or gouping of any sheets of the ream. There is no appreciable sagging of the ream into thhe slot 23, since this slot is narrow, and this avoids damaging of the ream along the edges of the slot as the ream moves forward. While the ream may sag down somewhat at the edges of the foot 79 of the pusher plate 31, this is not damaging since there is no relative movement between the foot and the ream.

In view of the above, it will be seen that the several objects of the invention are achieved and other advantageous results attained.

As various changes could be made in the above methods without departing from the scope of the invention, it is intended that all matter contained in the above description or shown in the accompanying drawings shall be interpreted as illustrative and not in a limiting sense.

What is claimed is:

1. Apparatus for feeding stacks of sheets, such as reams of paper or the like, comprising flight conveyor means for pushing the stacks forward, said flight conveyor means comprising a table having an upper surface on which stacks may slide, the table having a relatively narrow slot extending in the direction of feed, endless conveyor means having flights spaced at intervals along its length and extending outwardly therefrom for pushing the stacks along the table, said conveyor means having an upper reach extending under the table in the direction of feed and movable in the direction of feed, each flight having a relatively narrow section adapted, in its travel with the upper reach of the conveyor means, to extend up through said slot, and a relatively wide pusher face adapted, as the flight moves forward with the upper reach of the conveyor means, to travel over the table and push a stack forward on the table, each flight having a foot extending forwardly from its said pusher face adapted, in the travel of the flight with the upper reach of the conveyor means, to travel at a level for supporting the stack being pushed forward by said face, stacks being fed on to the table to a dwell position between successive flights for support by the table at a level below said level of said foot, and means for lifting a stack in its said dwell position to a level at which the lower surface of at least a portion of the stack is above said level of said foot for entry under the lifted stack of the foot of the flight coming into engagement with the trailing side of the stack, the stack being supported on said foot as said flight travels forward.

2. Apparatus as set forth in claim 1 wherein the pusher face of each flight extends laterally outward on both sides of said slot and the foot of each flight extends the width of the pusher face of the flight.

3. Apparatus as set forth in claim 2 wherein each flight comprises a relatively narrow arm adapted to extend up through said slot and wherein the pusher face and foot of each flight are constituted by a plate secured to the arm having a forwardly extending flange forming said foot at the edge of the plate which is its bottom edge as the plate and arm travel forward with the upper reach of the conveyor means.

4. Apparatus as set forth in claim 1 wherein the means for lifting the stack comprises a lifter movable between a lowered position enabling feeding a stack over the table to said dwell position and a raised position for lifting the infed stack.

5. Apparatus for feeding stacks of sheets, such as reams of paper or the like, comprising flight conveyor means for pushing the stacks forward, said flight conveyor means comprising a table having an upper surface on which stacks may slide, the table having a relatively narrow slot extending in the direction of feed, endless conveyor means having flights spaced at intervals along its length and extending outwardly therefrom for pushing the stacks along the table, said conveyor means having an upper reach extending under the table in the direction of feed and movable in the direction of feed, each flight having a relatively narrow section adapted, in its travel with the upper reach of the conveyor means, to extend up through said slot, and a relatively wide pusher face adapted, as the flight moves forward with the upper reach of the conveyor means, to travel over the table and push a stack forward on the table, each flight having a foot extending forwardly from its said pusher face adapted, in the travel of the flight with the upper reach of the conveyor means, to travel at a level for supporting the stack being pushed forward by said face, stacks being fed on to the table to a dwell position between successive flights, means for lifting a stack in its said dwell position for entry under the lifted stack of the foot of the flight coming into engagement with the trailing side of the stack, the stack being supported on said foot as said flight travels forward, said means for lifting the stack comprising a lifter movable between a lowered position enabling feeding a stack over the table to said dwell position and a raised position for lifting the infed stack, and means for operating the lifter to lift a stack in timed relation to the delivery of the stack to the dwell position, the lifter being lowered when the foot of a flight has travelled forward under the lifted stack.

6. Apparatus as set forth in claim 4 wherein the lifter has an upper surface which, in the lowered position of the lifter, is generally flush with the upper surface of the table.

7. Apparatus for feeding stacks of sheets, such as reams of paper or the like, comprising flight conveyor means for pushing the stacks forward, said flight conveyor means comprising a table having an upper surface on which stacks may slide, the table having a relatively narrow slot extending in the direction of feed, endless conveyor means having flights spaced at intervals along its length and extending outwardly therefrom for pushing the stacks along the table, said conveyor means having an upper reach extending under the table in the direction of feed and movable in the direction of feed, each flight having a relatively narrow section adapted, in its travel with the upper reach of the conveyor means, to extend up through said slot, and a relatively wide pusher face adapted, as the flight moves forward with the upper reach of the conveyor means, to travel over the table and push a stack forward on the table, each flight having a foot extending forwardly from its said pusher face adapted, in the travel of the flight with the upper reach of the conveyor means, to travel at a level for supporting the stack being pushed forward by said face, stacks being fed on to the table to a dwell position between successive flights, means for lifting a stack in its said dwell position for entry under the lifted stack of the foot of the flight coming into engagement with the trailing side of the stack, the stack being supported on said foot as said flight travels forward, said means for lifting the stack comprising a lifter movable between a lowered position enabling feeding a stack over the table to said dwell position and a raised position for lifting the infed stack, said lifter having an upper surface, in the lowered position of the lifter, generally flush with the upper surface of the table, and means for operating the lifter to lift a stack in timed relation to the delivery of the stack to the dwell position, the lifter being lowered when the foot of a flight has travelled forward under the lifted stack.

8. Apparatus for feeding stacks of sheets, such as reams of paper or the like, comprising flight conveyor means for pushing the stacks forward, said flight conveyor means comprising a table having an upper surface on which stacks may slide, the table having a relatively narrow slot extending in the direction of feed, endless conveyor means having flights spaced at intervals along its length and extending outwardly therefrom for pushing the stacks along the table, said conveyor means having an upper reach extending under the table in the direction of feed and movable in the direction of feed, each flight having a relatively narrow section adapted, in its travel with the upper reach of the conveyor means, to extend up through said slot, and a relatively wide pusher face adapted, as the flight moves forward with the upper reach of the conveyor means, to travel over the table and push a stack forward on the table, each flight having a foot extending forwardly from its said pusher face adapted, in the travel of the flight with the upper reach of the conveyor means, to travel at a level for supporting the stack being pushed forward by said face, stacks being fed on to the table to a dwell position between successive flights, and means for lifting a stack in its said dwell position for entry under the lifted stack of the foot of the flight coming into engagement with the trailing side of the stack, the stack being supported on said foot as said flight travels forward, said means for lifting the stack comprising a lifter movable between a lowered position enabling feeding a stack over the table to said dwell position and a raised position for lifting the infed stack, said lifter having an upper surface, in the lowered position of the lifter, generally flush with the upper surface of the table, said lifter further comprising an elongate plate extending longitudinally of the table at one side of the slot, said plate being pivoted at its downstream end for swinging movement about a transverse axis for the lifting and lowering thereof, and means for swinging said plate from its lowered to its lifted position and back.

9. Apparatus as set forth in claim 8 having means for operating the swinging means to swing up the plate in timed relation to the delivery of the stack to the dwell position, the plate being lowered when the foot of a flight has travelled forward under the lifted stack.

* * * * *